US006481963B1

(12) United States Patent
Lin et al.

(10) Patent No.: US 6,481,963 B1
(45) Date of Patent: Nov. 19, 2002

(54) AXIAL-FLOW FAN HAVING AN AIR GAP GENERATION MEMBER

(75) Inventors: Kuo-Cheng Lin, Taoyuan (TW); Yung-Hua Liu, Taipei (TW)

(73) Assignee: Delta Electronics, Taoyuan (TW)

( * ) Notice: Subject to any disclaimer, the term of this patent is extended or adjusted under 35 U.S.C. 154(b) by 0 days.

(21) Appl. No.: 09/652,961

(22) Filed: Aug. 31, 2000

(30) Foreign Application Priority Data

Sep. 3, 1999 (TW) ..... 88215121 U

(51) Int. Cl.[7] ..... F04D 29/32

(52) U.S. Cl. ..... 415/220; 416/189; 416/191; 416/195

(58) Field of Search ..... 415/220, 223, 415/228, 213.1, 214.1, 211.2; 416/189, 191, 192, 194, 195; 417/423.1, 423.14

(56) References Cited

U.S. PATENT DOCUMENTS

| | | | | | |
|---|---|---|---|---|---|
| 254,985 | A | * | 3/1882 | Kirkwood | 416/195 |
| 899,607 | A | * | 9/1908 | McKee | 416/191 |
| 1,742,510 | A | * | 1/1930 | Hubbell, Jr. | 415/211.2 |
| 3,034,762 | A | * | 5/1962 | Fanti et al. | 416/195 |
| 3,601,500 | A | * | 8/1971 | Palfreyman et al. | 415/195 |
| 4,287,137 | A | * | 9/1981 | Sonoyama et al. | 416/189 |
| 4,413,947 | A | * | 11/1983 | Seki | 415/220 |
| 5,927,944 | A | * | 7/1999 | Belady | 415/220 |

FOREIGN PATENT DOCUMENTS

| | | | | | |
|---|---|---|---|---|---|
| IT | 587762 | A | * | 1/1959 | 417/423.14 |
| SU | 848764 | A | * | 7/1981 | 416/195 |

* cited by examiner

*Primary Examiner*—Christopher Verdier
(74) *Attorney, Agent, or Firm*—MacPherson Kwok Chen & Heid LLP

(57) ABSTRACT

An axial-flow fan device includes a fan frame having an intake opening and an outlet opening, and an impelling apparatus mounted in the fan frame and having fan blades and an air gap generation member surrounding the fan blade. The air gap generation member which is made of a plurality of rings is mounted on a blade wheel and connected to the ends of the fan blades to reinforce the fan blades, with each of the rings overlapping and separated from each other for generating a plurality of air gaps when the fan blades rotate.

13 Claims, 5 Drawing Sheets

AXIAL-FLOW FAN HAVING AN AIR GAP GENERATION MEMBER

FIELD OF THE INVENTION

The present invention is generally related to an axial-flow fan device for cooling an electronic device.

BACKGROUND OF THE INVENTION

As a general rule an axial-flow fan device is employed in cooling an electronic device such as a power supply or a central processing unit (CPU). Typically, an axial-flow fan device is constituted by fan blades attached to an annular impeller and is mounted in a fan frame. The axial-flow fan is operated by generating a control signal in the form of a square wave to alter the magnetic field of the stator of the axial-flow fan, and further the alteration of the magnetic field of the stator will mutually act on the annular impeller so as to drive the fan blades to rotate.

FIGS. 1(*a*) through 1(*c*) shows the side view, the rear-end view, and the top view of an axial-flow fan according to the prior art. Four ribs 111 arranged on the fan frame 11 are used to support the bottom plate 112 in which the stator is disposed. The fan blades are surrounded with the fan frame segment 113 as shown in FIG. 1(*b*). The gaps between the ribs form a large vent for enabling the airflow to flow in/out the fan. While the fan blades are rotating, the cooling air will flow in the fan through an intake opening and flow out of the fan through an outlet opening so as to dissipate the heat out of the electronic device.

Nonetheless, there are several disadvantages in the axial-flow fan of the prior art. One is that the fan frame segment 113 surrounding the fan blades will obstruct the airflow and make the intake opening and the outlet opening narrow and small. Therefore, the air capacity for heat-dissipation is reduced and the heat-dissipating effect is not well accordingly. Furthermore, if the fan blades are thin and long, the fan blades will become frangible.

Consequently, it is desirable to modify the conventional axial-flow fan to increase the air capacity for heat-dissipation and reinforce the fan blades.

SUMMARY OF THE INVENTION

It is an object of the present invention to provide an axial-flow fan with an increased air capacity.

It is another object of the present invention to provide an axial-flow fan having reinforced fan blades.

A preferred embodiment of the present invention is an axial-flow fan for cooling an electronic device, including: a fan frame having an intake opening and an outlet opening, an impelling apparatus mounted in the fan frame and having a fan blade and an air gap generation member thoroughly surrounding the fan blade, wherein the air gap generation member is connected to the end of the fan blade for generating an air gap when the fan blade rotates.

In accordance with a preferred embodiment of the present invention, the fan blade is free from being surrounded with the fan frame.

In accordance with a preferred embodiment of the preset invention, the impelling apparatus further includes an impeller for the fan blade to be attached thereon and a blade wheel for the air gap generation member to be mounted thereon.

Preferably, the air gap generation member is made of a plurality of rings parallel to the surface of the fan frame, each of which overlaps and separates each other so as to form the air gap. Optionally, the rings may be discontinuous.

The air gap generation member can be alternatively made of a plurality of sloped structures nonparallel to the surface of the fan frame, for example, spirals.

Another preferred embodiment of the present invention is an axial-flow fan cooling an electronic device, including: a fan frame having an intake opening and an outlet opening, an impelling apparatus mounted in the fan frame and having a fan blade and an air gap generation member partially surrounding the fan blade, wherein the air gap generation member is connected to the end of the fan blade for generating an air gap when the fan blade rotates.

The fan blade is free from being surrounded with the fan frame and the fan frame is arranged on the side of the air gap generation member. Alternatively, a portion of the fan blade is surrounded with the fan frame.

Moreover, the impelling apparatus further includes an impeller for the fan blade to be attached thereon and a blade wheel for the air gap generation member to be mounted thereon.

Preferably, the air gap generation member is made of a plurality of rings parallel to the surface of the fan frame, each of which overlaps and separates each other so as to form the air gap. Optionally, the rings may be discontinuous.

An alternative design of the air gap generation member can be made of a plurality of sloped structures nonparallel to the surface of the fan frame, for example, spirals.

Now the foregoing and other features of the present invention may best be understood through the following descriptions with reference to the accompanying drawings, in which:

BRIEF DESCRIPTION OF THE DRAWINGS

FIG. 4(*b*) shows the side view of the axial-flow fan, where a portion of the fan blades is partially surrounded with an air gap generation member consisting of a plurality of rings and the other portion of the fan blades is surrounded with the fan frame according to another preferred embodiment of the present invention;

FIG. 4(*c*) shows the side view of the axial-flow fan, where the impelling apparatus of the present invention is mounted in the fan frame used in the conventional axial-flow fan.

DETAILED DESCRIPTION OF THE PREFERRED EMBODIMENTS

Figure 1B:
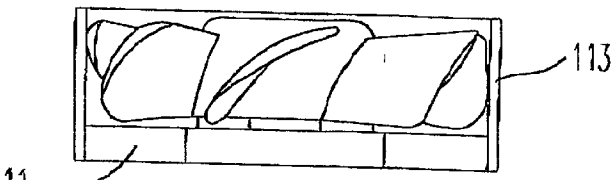
Fig. 1(b)(PRIOR ART)
FIGS. 1(*a*) through 1(*c*) respectively show the side view, the rear-end view, and the top view of an axial-flow fan according to the prior art.
Figure 1C:
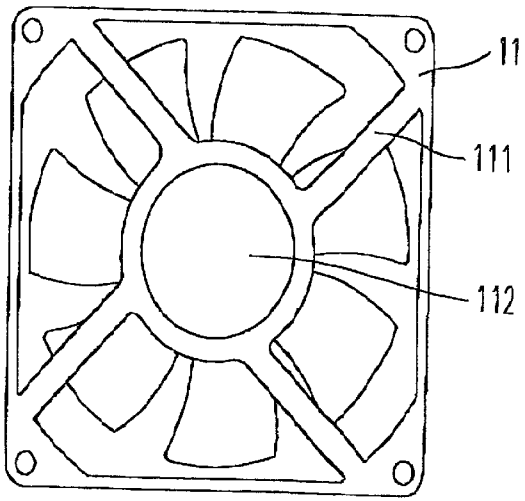
Fig. 1(c)(PRIOR ART)
Figure 1A:
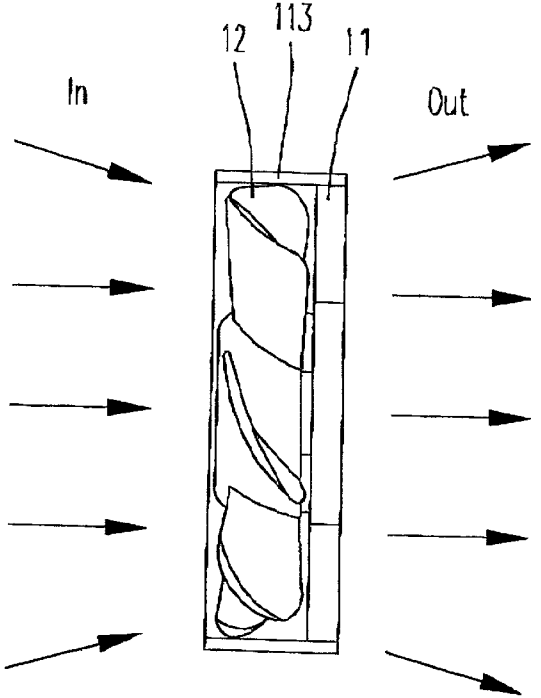
Fig. 1(a)(PRIOR ART)
Figure 2B:
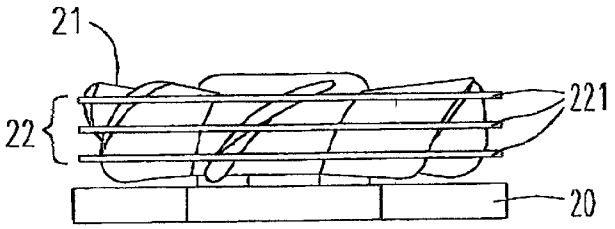
FIGS. 2(*a*) through 2(*c*) respectively show the side view, the rear-end view, and the top view of an axial-flow fan according to the present invention.
Figure 2C:
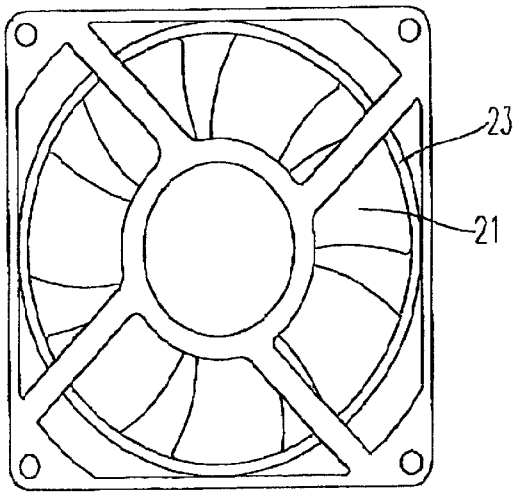
Figure 2A:
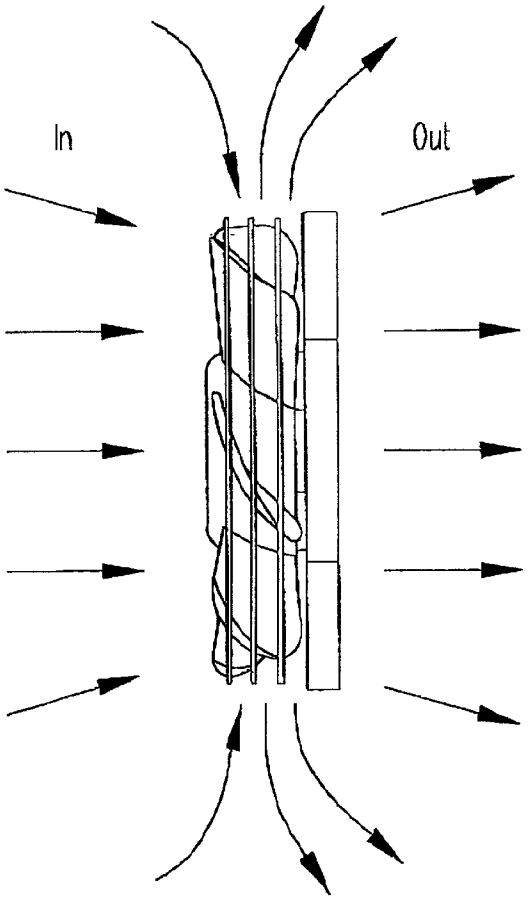

Referring to FIGS. 2(*a*) through 2(*c*), the axial-flow fan of the present invention is constituted by a fan frame with an impelling apparatus mounted therein. The impelling apparatus includes a plurality of fan blades 21 attached to an annular impeller (not shown). It is worthwhile to note that the fan frame 20 does not surround the fan blades 21. The impelling apparatus further includes an air gap generation member 22 thoroughly surrounding the fan blades 21. It is remarkable that the air gap generation member 22 in this preferred embodiment is made of a plurality of rings 221 mounted on a blade wheel 23. Each of the rings 221 overlaps and separates each other so as to form a plurality of air gaps. Besides, the inner peripheries of the rings 221 are connected to the ends of the fan blades 21. In this way, the fan blades 21 are reinforced and the air capacity is increased as the fan blades rotate.

Figure 3C:
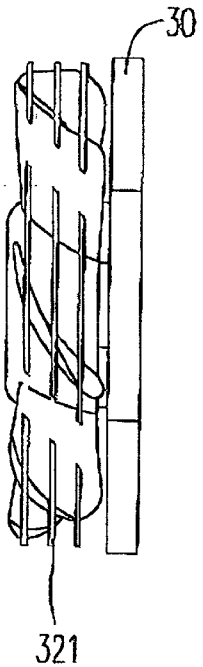
FIGS. 3(*a*) through 3(*c*) respectively show the side views of the axial-flow fan, wherein fan blades are thoroughly surrounded with an air gap generation member consisting of a plurality of rings, spirals and discontinuous rings according to a preferred embodiment of the present invention.
Figure 3B:
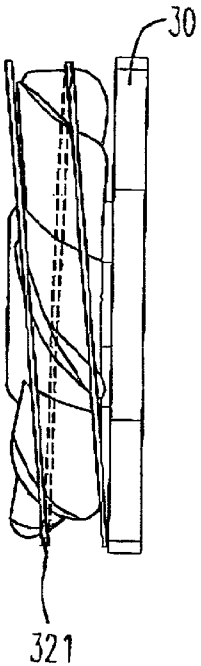
Figure 3A:
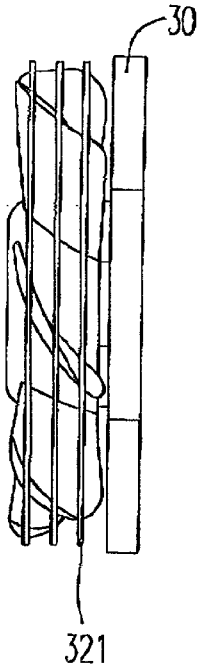

Refer to FIGS. 3(*a*) through 3(*c*) showing a preferred embodiment of the present invention. The air gap generation member may be made of a plurality of rings 321 parallel to the surface of the fan frame 30 as shown in FIG. 3(*a*), or a plurality of sloped structure nonparallel to the surface of the fan frame 30, for example, spirals 321 as shown in FIG. 3(*b*). An alternative design of FIG. 3(*a*) is that the rings 321 are configured to be discontinuous as shown in FIG. 3(*c*).

Figure 4A:
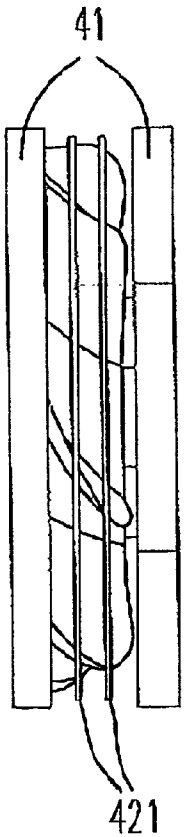
FIG. 4(*a*) shows the side view of the axial-flow fan, where the fan blades are partially surrounded with an air gap generation member consisting of a plurality of rings and the fan frames are arranged on the sides of the air gap generation member according to another preferred embodiment of the present invention.
Figure 4B:
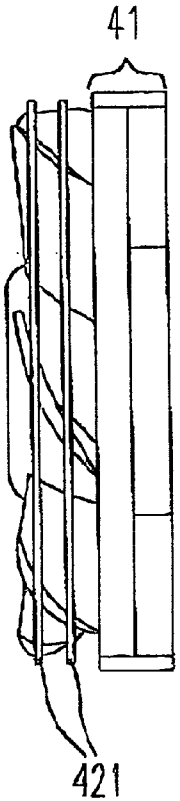
Figure 4C:
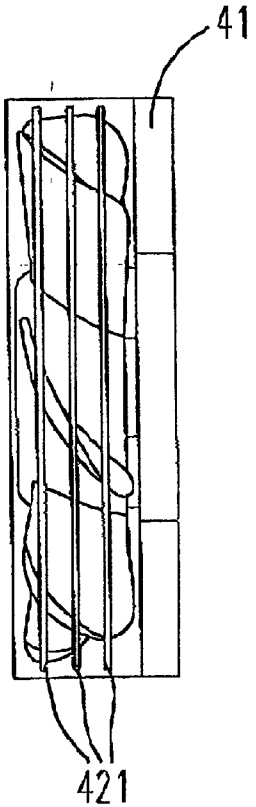
Figure 5:
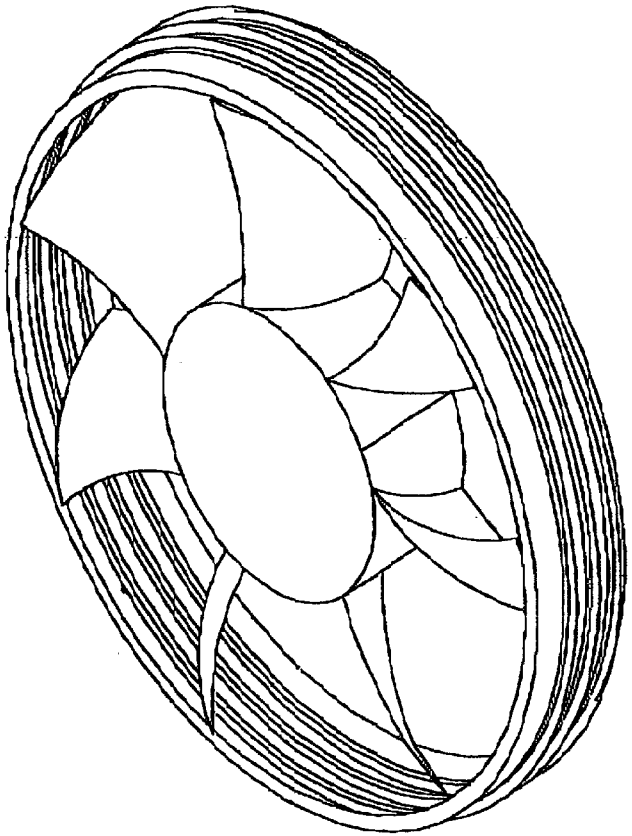
FIG. 5 is an elevation view of the impelling apparatus according to a preferred embodiment of the present invention.

In addition to the configurations of air gap generation member as shown in FIGS. 3(*a*) through 3(*c*), the air gap generation member can be configured to partially surround the fan blades as shown in FIG. 4(*a*) and FIG. 4(*b*). As can be seen from FIG. 4(*a*), the rings 421 partially surround the fan blades, and the fan frames 41 are arranged on the sides of the rings 421. In FIG. 4(*b*), a portion of the fan blades is surrounded with the rings 421, and the other portion of the fan blades is surrounded with the fan frame 41. In FIG. 4(*c*), it can be known that the impelling apparatus of the present invention can be applied to be mounted in the fan frame used in the current axial-flow fan device. FIG. 5 is an elevation view of the impelling apparatus according to a preferred embodiment of the present invention.

The conspicuous feature of the axial-flow fan according to the present invention is that an air gap generation member which is made of a plurality of rings is mounted on a blade wheel and connected to the ends of the fan blades for reinforcing the fan blades, with each of the rings overlaps and separates each other for generating a plurality of air gaps when the fan blades rotate. Therefore, the air capacity is increased due to the air gap generated by the air gap generation member and the fan blades are reinforced.

Although the present invention has been described and illustrated in detail, it is to be clearly understood that the same is by the way of illustration and example only and is riot to be taken by way of limitation, the spirit and scope of the present invention being limited only by the terms of the appended claims.

We therefore claim:

1. An axial-flow fan device for cooling an electronic device, comprising:

a fan frame having an intake opening and an outlet opening; and an impelling apparatus mounted in said fan frame and having a fan blade and an air gap generation member thoroughly surrounding said fan blade;

wherein said air gap generation member is made of a plurality of rings parallel to the surface of said fan frame, each of which overlaps and separates each other so as to form an air gap, and is connected to the end of said fan blade for generating said air gap when said fan blade rotates in order to increase air capacity for heat-dissipation.

2. The axial-flow fan device according to claim 1 wherein said fan blade is free from being surrounded with said fan frame.

3. The axial-flow fan device according to claim 1 wherein said impelling apparatus further includes an impeller for said fan blade to be attached thereon.

4. The axial-flow fan device according to claim 1 wherein said impelling apparatus further includes a blade wheel for said air gap generation member to be mounted thereon.

5. The axial-flow fan device according to claim 1 wherein said rings are discontinuous.

6. An axial-flow fan device for cooling an electronic device, comprising:

a fan frame having an intake opening and an outlet opening; and an impelling apparatus mounted in said fan frame and having a fan blade and an air gap generation member thoroughly surrounding said fan blade;

wherein said air gap generation member is made of helical spirals, and is connected to the end of said fan blade for generating an air gap when said fan blade rotates in order to increase air capacity for heat-dissipation.

7. An axial-flow fan device for cooling an electronic device, comprising:

a fan frame having an intake opening and an outlet opening; and an impelling apparatus mounted in said fan frame and having a fan blade and an air gap generation member partially surrounding said fan blade;

wherein said air gap generation member is made of a plurality of rings parallel to the surface of said fan frame, each of which overlaps and separates each other so as to form an air gap, and is connected to the end of said fan blade for generating said air gap when said fan blade rotates in order to increase air capacity for heat-dissipation.

8. The axial-flow fan device according to claim 7 wherein said fan frame is arranged on a side of said air gap generation member.

9. The axial-flow fan device according to claim 7 wherein a portion of said fan blade is surrounded with said fan frame.

10. The axial-flow fan device according to claim 7 wherein said impelling apparatus further includes an impeller for said fan blade to be attached thereon.

11. The axial-flow fan device according to claim 7 wherein said impelling apparatus further includes a blade wheel for said air gap generation member to be mounted thereon.

12. The axial-flow fan device according to claim 7 wherein said rings are discontinuous.

13. An axial-flow fan device for cooling an electronic device, comprising:

a fan frame having an intake opening and an outlet opening; and an impelling apparatus mounted in said fan frame and having a fan blade and an air gap generation member partially surrounding said fan blade;

wherein said air gap generation member is made of helical spirals, and is connected to the end of said fan blade for generating an air gap when said fan blade rotates in order to increase air capacity for heat-dissipation.

* * * * *